United States Patent [19]

Wieland

[11] 4,224,873

[45] Sep. 30, 1980

[54] CLAMPING GRIPPER

[75] Inventor: Erich G. Wieland, Wurzburg, Fed. Rep. of Germany

[73] Assignee: Koenig & Bauer Aktiengesellschaft, Wurzburg, Fed. Rep. of Germany

[21] Appl. No.: 911,573

[22] Filed: Jun. 1, 1978

[30] Foreign Application Priority Data

Jun. 6, 1977 [DE] Fed. Rep. of Germany ..... 2725035

[51] Int. Cl.[2] ..... B41F 21/04

[52] U.S. Cl. ..... 101/409; 271/82; 271/277

[58] Field of Search ..... 101/409-412; 271/82, 277

[56] References Cited

U.S. PATENT DOCUMENTS

| | | | |
|---|---|---|---|
| 323,168 | 7/1885 | Lindemeyer | 101/412 |
| 1,384,778 | 7/1921 | Rich | 101/412 |
| 1,483,057 | 2/1924 | Warsen | 101/412 |
| 1,600,790 | 9/1926 | Blaine | 101/412 |
| 1,607,142 | 11/1926 | White | 101/409 |
| 2,092,189 | 9/1937 | Stobb | 101/410 |
| 3,536,321 | 10/1970 | Stranbe | 101/409 |
| 3,650,211 | 3/1972 | Nentwich | 101/409 |
| 3,788,639 | 1/1974 | Brn | 101/409 |

FOREIGN PATENT DOCUMENTS

| | | | |
|---|---|---|---|
| 506283 | 8/1930 | Fed. Rep. of Germany | 101/410 |
| 670298 | 12/1938 | Fed. Rep. of Germany | 101/412 |
| 1174804 | 7/1964 | Fed. Rep. of Germany | 101/412 |
| 1761033 | 4/1971 | Fed. Rep. of Germany | 101/412 |
| 4345 | 12/1891 | Switzerland | 101/412 |
| 310177 | 4/1929 | United Kingdom | 101/410 |

*Primary Examiner*—William Pieprz

*Attorney, Agent, or Firm*—Jones, Tullar & Cooper

[57] ABSTRACT

A clamping gripper assembly for use in a sheet transfer mechanism in a printing machine is disclosed. A gripper finger coacts with a gripper abutment surface with the gripper finger being spring loaded and secured to an oscillating gripper shaft which is provided with a flat face about a portion of its periphery. Oscillation of the shaft brings the gripping tip of the gripper into contact with the gripper abutment. A hinge joint is provided between the gripper finger and gripper shaft and allows pivotal movement therebetween.

5 Claims, 3 Drawing Figures

CLAMPING GRIPPER

FIELD OF THE INVENTION

The present invention is directed generally to a sheet transfer mechanism in a printing machine. More particularly, the present invention is directed to a clamping gripper in a sheet transfer mechanism. Most specifically, the present invention is directed to a clamping gripper which is spring loaded and hingedly secured to an oscillating gripper shaft.

The clamping gripper in accordance with the present invention is comprised generally of a curved gripping finger having a gripper tip at a first end and a gripper base at a second end. Intermediate its two ends, the gripper finger is secured to, and spring biased form, an oscillating gripper shaft. An adjusting screw is provided and serves to adjust the gap between the gripping tip and a gripper abutment surface. The adjusting screw passes through the gripper finger and contacts a flat face on the gripper shaft. A cooperating notch and shoulder on the shaft and gripper base form a hinge joint between the shaft and finger. Alternatively, the notch can be formed on the base of the finger and the shoulder on the gripper shaft.

DESCRIPTION OF THE PRIOR ART

Clamping grippers for use with sheet-fed rotary printing machines are generally known in the art as may be seen, for example, in German Utility Model No. 6,906,453 in which gripper fingers are journaled on hinge-like clamping members and are clamped on a gripper shaft. Grippers such as these are quite expensive, require exact and careful mounting, and are not easily or quickly exchangeable should this become necessary. If each gripper is not carefully secured to the periphery of the gripper shaft, the gripping of the sheets of paper is not performed accurately with a consequential waste of paper and time. The prior art grippers, since they are journaled on the gripper shaft, also require bearings and lubrication or the like.

SUMMARY OF THE INVENTION

It is an object of the present invention to provide a clamping gripper for a sheet transfer mechanism.

A further object of the present invention is to provide a spring biased clamping gripper securable to an oscillating gripper shaft.

Yet another object of the present invention is to provide a clamping gripper which is easily and quickly adjustable.

Still a further object of the present invention is to provide a clamping gripper which can be rapidly removed from the gripper shaft and replaced.

As will be discussed in greater detail in the description of preferred embodiments, the clamping gripper in accordance with the present invention is comprised generally of a gripping finger which is secured to an oscillating gripper shaft through a spring loaded connection. Cooperating hinge means at one end of the gripping finger and on the gripper shaft provide a hinge point for the gripping finger when it is brought into contact with a gripper abutment surface during oscillation of the gripper shaft. The spacing between the gripper tip of the gripper finger and the abutment surface may be adjusted by an adjusting screw which is secured to the finger and which contacts a flat face on the gripper shaft.

The clamping gripper in accordance with the present invention is easily and quickly attached to or removed from the gripper shaft. The spacing between the gripper tip and the abutment surface is quickly adjustable and the gripper has no bearings and thus does not require lubrication. The pressure required to either open or close the gripper is approximately equal and the gripper tip separates from the abutment surface to insure proper sheet release. The gripper is also unaffected by build up of contamination such as paper scraps and the like about the gripper or the gripper shaft. The clamping gripper of the present invention is not expensive, is durable, and is easy to adjust and maintain.

BRIEF DESCRIPTION OF THE DRAWINGS

While the novel features of the clamping gripper of the present invention are set forth with particularity in the appended claims, a full and complete understanding of the invention may be had by referring to the following description of preferred embodiments and as shown in the accompanying drawings in which:

DESCRIPTION OF PREFERRED EMBODIMENTS

Figure 1:
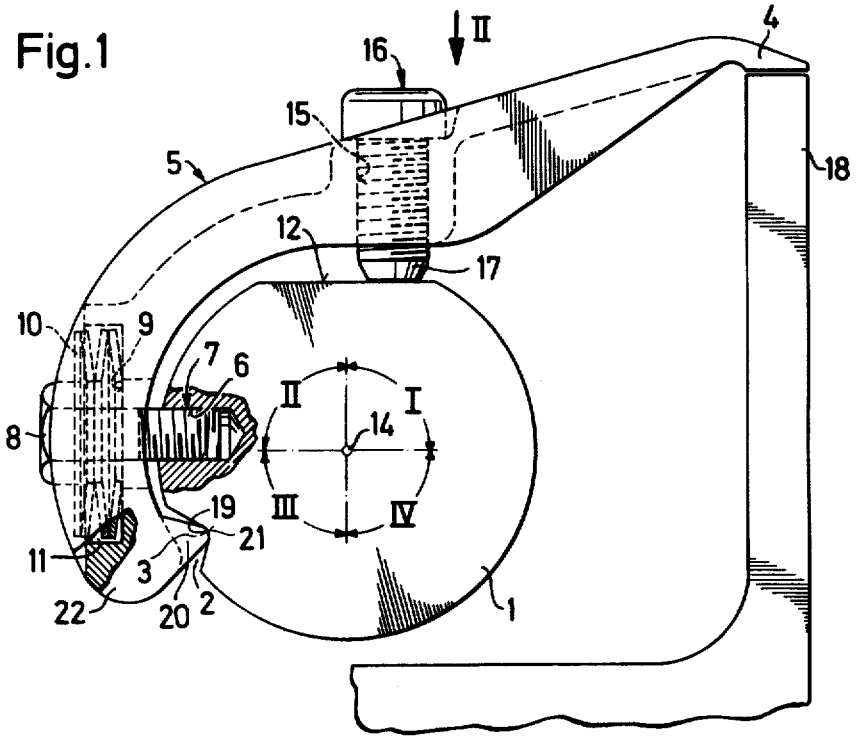
FIG. 1 is a schematic side elevation view, partly in section, of a first preferred embodiment of a clamping gripper in accordance with the present invention.
Figure 2:
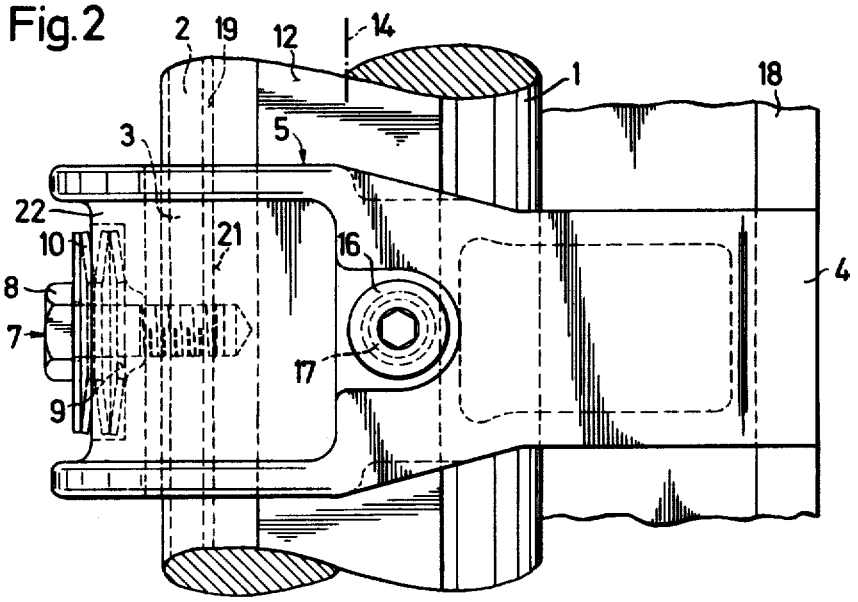
FIG. 2 is a top plan view of the clamping gripper of FIG. 1.

Turning now to FIG. 1, there may be seen a preferred embodiment of a clamping gripper in accordance with the present invention. A gripper shaft 1 is journaled in a conventional manner in the side flanges of a printing cylinder (not shown). This gripper shaft is controlled in a known manner such as, for example, by a cam and a roller which rotates on the cam with the roller being secured to one end of a lever whose other end is keyed to the gripper shaft. This means for causing oscillation of the gripper shaft 1 is conventional and other similar means for causing oscillation of shaft 1 could also be utilized. While gripper shaft 1 is discussed as being used as a sheet transfer mechanism in a sheet-fed rotary printing machine, it will be understood that it is also suitable for use in other apparatus such as collecting cylinders for folders and the like.

Referring again to FIG. 1, a notch 2 may be milled in the gripper shaft 1, and extends parallel to the longitudinal axis of this gripper shaft 1. In the embodiment shown in FIG. 1, the notch 2 has an approximately wedge-shaped cross section, with a tip 19 of the notch 2 being directed toward the axis of rotation 14 of the gripper shaft 1 and being rounded off. A gripper finger 5 of approximately 15 mm to 30 mm width has a gripper tip 4 on its upper end and a gripper base 22 on its lower end, this gripper base 22 having a shoulder portion 3 which is integrally formed with or secured to the gripper base 22. Shoulder 3 preferably has a width equal to that of the gripper finger 5 and also has a wedge-shaped cross section 20 adapted to correspond generally to the cross section of notch 2 in such a manner that a pivoting movement between shoulder 3 and notch 2 is possible so that the gripper finger 5 is hingedly joined with gripper shaft 1. A tip portion 21 of the shoulder 3 is rounded-off to correspond with the radius of the tip 19 of the notch 2. Notch 2 forms a first part of the hinge and shoulder 3 forms the other part so that the notch 2 and shoulder 3 cooperate to form the hinge.

Gripper shaft 1 may, for ease of reference, have its cross section divided into four quadrants I, II, III, and IV, with notch 2 being located approximately in the center of quadrant III. Between quadrant III and quadrant II, a plurality of threaded, bored holes 6 are provided in the gripper shaft 1 spaced from each other along the direction of the longitudinal axis of shaft 1. These threaded holes serve to receive hexagon headed screws 7. A recess 11 is milled into the lower part of the gripper finger 5 and between a base portion 9 of the recess 11 and a head 8 of the hexagon screw 7, a unit for storing mechanic energy, for example, a plurality of compression springs 10, is secured. The compression springs 10 press the shoulder 3 into the notch 2 maintaining contact between shoulder 3 and notch 2 to form the hinge even if portions of shoulder 3 have been worn away.

A threaded aperture 15 is provided approximately halfway between the center of the gripper tip 4 and the shoulder 3 of the gripper finger 5 and in the middle of its width. An adjusting screw 16 is screwed into this threaded aperture 15, and the end of adjusting screw 16 is equipped with a journal 17. This journal 17 seats on a face 12 milled in the gripper shaft 1, the milled face 12 extending parallel to the axis of the gripper shaft 1. By means of the adjusting screw 16 it is thus possible to adjust each gripper to its corresponding gripper abutment surface 18. Such individual gripper adjustment is required for assuring a simultaneous closing and opening of all the grippers. The hexagon head screw 7 allows the adjustment of the compression springs 10 and thus of the compression spring force on the gripper.

Figure 3:
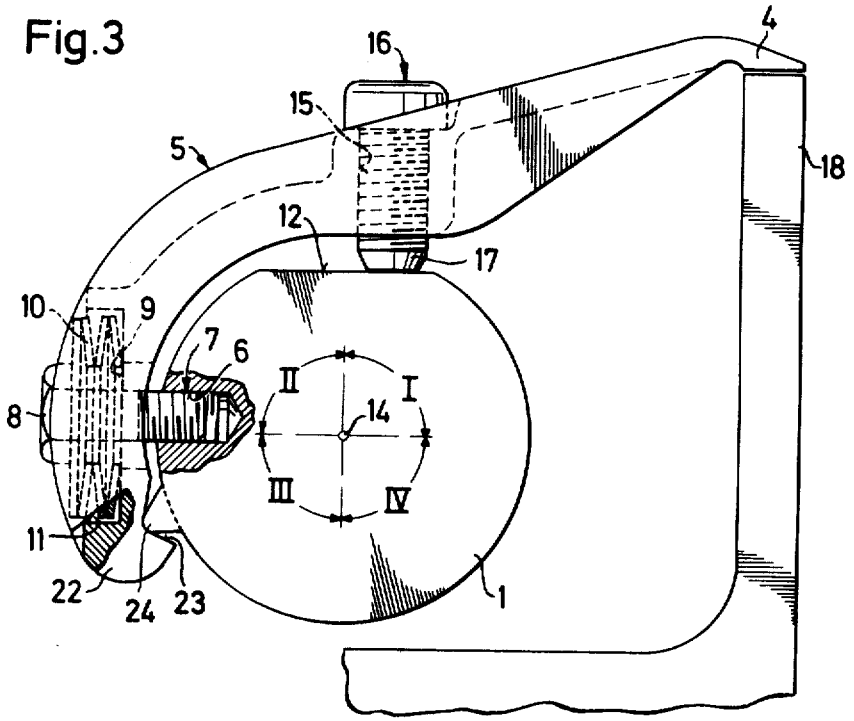
FIG. 3 is a schematic side elevation view, partly in section, of a second preferred embodiment of a clamping gripper in accordance with the present invention.

A second preferred embodiment of a clamping gripper in accordance with the present invention is shown in FIG. 3. In this embodiment, a notch 23 is formed in the gripper base 22 and a shoulder 24 is provided on shaft 1. As discussed in connection with the first embodiment, notch 23 and shoulder 24 are of a corresponding shape and cooperate to form a hinge-like joint between the gripper finger 5 and the gripper shaft 1.

In operation, oscillation of the gripper shaft 1 causes a corresponding movement of the gripper tip 4 toward and away from the gripper abutment surface 18. The clearance between the tip and the abutment surface can be varied by movement of the adjusting screw 16. Since gripping finger 5 is joined to shaft 1 through the hexagonal headed screw 7 and is spring biased by compression springs 10, it may be seen that finger 10 will pivot with regard to shaft 1 about the hinge point formed by notch 2 and shoulder 3 or by notch 23 and shoulder 24 in FIGS. 1 and 3 respectively, when gripper tip 4 contacts abutment surface 18. The amount of force which tip 4 can apply to surface 18 can be varied by adjusting the compression springs 10 either by tightening or loosening screw 7 or by substituting different springs.

Gripper finger 5 is not journaled about shaft 1 and can easily be removed and replaced when necessary. The hexagonal headed screw 7 may be removed and the finger 5 is thereby disconnected from gripper shaft 1. This disconnection and substitution is made possible by the hinge-like cooperation between notch 2 and shoulder 3 or notch 23 and shoulder 24.

It may thus be seen that preferred embodiments of a clamping gripper in accordance with the present invention have been fully and completely set forth hereinabove. It will be obvious to one of ordinary skill in the art that a number of changes in, for example, the shape of the clamping finger, the type of compression means used, the specific shape of the hinge connection, the spacing of the adjustment screw and the like could be made without departing from the true spirit and scope of the invention and, accordingly, the invention is to be limited only by the following claims.

I claim:

1. A clamping gripper for a sheet transfer mechanism in a printing machine, said clamping gripper comprising:

a gripper finger having a gripper tip at a first end and a gripper base at a second end of said gripper finger;

means for directly securing said gripper finger to an oscillating gripper shaft in the sheet transfer mechanism, said securing means including a securing screw passing through said gripper finger between said gripper base and said gripper tip and adapted to be directly received in a threaded hole in said gripper shaft, and a spring means retained between a head portion of said securing screw and said gripper finger to spring bias said gripper finger toward said gripper shaft;

a hinge joint between said gripper base and said gripper shaft for allowing relative pivotal movement between said gripper finger and said gripper shaft during operation of said sheet transfer mechanism, said hinge joint being formed by a portion of said gripper base having a first shape and a cooperating portion of said gripper shaft having a corresponding second shape, said shaped portion of said gripper shaft extending along the length of said gripper shaft and parallel to the axis of said gripper shaft;

an adjusting screw for adjusting the spacing between said gripper tip and a gripper abutment surface of said sheet transfer mechanism, said adjusting screw passing through said gripper finger between said securing screw and said gripper tip and having a journaled end which contacts a face portion of said gripper shaft whereby oscillation of said gripper shaft moves said gripper tip into and out of contact with said abutment surface;

said gripper finger extending around only a portion of the periphery of said gripper shaft so that said gripper finger is removable from said gripper shaft by unsecuring said securing screw from said gripper shaft, said gripper finger being removable while leaving said gripper shaft in the printing machine.

2. The clamping gripper of claim 1 wherein said hinge joint is a shoulder on said gripper base and a cooperating notch on said gripper shaft.

3. The clamping gripper of claim 1 wherein said hinge joint is a notch on said gripper base and a cooperating shoulder on said gripper shaft.

4. The clamping gripper of claim 2 wherein said notch and shoulder have wedge-shaped cross sections.

5. The clamping gripper of claim 3 wherein said notch and shoulder have wedge-shaped cross sections.

* * * * *